US009009950B2

(12) United States Patent
Lee et al.

(10) Patent No.: US 9,009,950 B2
(45) Date of Patent: Apr. 21, 2015

(54) METHOD FOR MANUFACTURING HIGH FREQUENCY INDUCTOR

(71) Applicant: Samsung Electro-Mechanics Co., Ltd., Suwon-si, Gyeonggi-do (KR)

(72) Inventors: Sang Moon Lee, Suwon-si (KR); Young Seuck Yoo, Suwon-si (KR); Jong Yun Lee, Suwon-si (KR); Young Do Kweon, Suwon-si (KR); Sung Kwon Wi, Suwon-si (KR)

(73) Assignee: Samsung Electro-Mechanics Co., Ltd., Gyeonggi-Do (KR)

( * ) Notice: Subject to any disclaimer, the term of this patent is extended or adjusted under 35 U.S.C. 154(b) by 219 days.

(21) Appl. No.: 13/804,250

(22) Filed: Mar. 14, 2013

(65) Prior Publication Data

US 2013/0333202 A1 Dec. 19, 2013

(30) Foreign Application Priority Data

Jun. 14, 2012 (KR) ..... 10-2012-0063825

(51) Int. Cl.
*H01F 7/06* (2006.01)
*H01F 41/02* (2006.01)
*H01F 41/04* (2006.01)

(52) U.S. Cl.
CPC ..... *H01F 41/02* (2013.01); *H01F 41/041* (2013.01)

(58) Field of Classification Search
CPC ... H01L 23/5227; H01L 28/10; H01F 27/324; H01F 41/02; H01F 41/04; H05K 2201/086
USPC ..... 29/602.1, 603.07, 603.16, 603.25, 825, 29/829, 874; 216/13, 41, 44, 47, 75; 430/170, 313, 320, 905
See application file for complete search history.

(56) References Cited

U.S. PATENT DOCUMENTS 6,641,984 B2 * 11/2003 Kamijima ..... 430/320
7,018,548 B2 * 3/2006 Kamijima ..... 216/2

FOREIGN PATENT DOCUMENTS

JP 2009-295759 12/2009
KR 10-2002-0005749 1/2002

* cited by examiner

*Primary Examiner* — Thiem Phan
(74) *Attorney, Agent, or Firm* — Bracewell & Giuliani LLP; Brad Y. Chin

(57) ABSTRACT

Disclosed herein is a method for manufacturing a high frequency inductor, the method including; forming a primary coil for manufacturing the high frequency inductor on a wafer; coating a primary PSV on the wafer on which the primary coil is formed; forming a secondary coil for manufacturing the high frequency inductor, after the coating of the primary PSV; coating a secondary PSV, after the forming of the secondary coil; forming a barrier layer on an electrode portion to be exposed of the high frequency inductor, after the coating of the secondary PSV; filling and curing an insulating resin on the wafer, after the forming of the barrier layer; and polishing the cured resin up to the barrier layer to expose the electrode.

9 Claims, 4 Drawing Sheets

- PRIOR ART -

METHOD FOR MANUFACTURING HIGH FREQUENCY INDUCTOR

CROSS REFERENCE(S) TO RELATED APPLICATIONS

This application claims the benefit under 35 U.S.C. Section 119 of Korean Patent Application Serial No. 10-2012-0063825, entitled "Method for Manufacturing High Frequency Inductor" filed on Jun. 14, 2012, which is hereby incorporated by reference in its entirety into this application.

BACKGROUND OF THE INVENTION

1. Technical Field

The present invention relates to a method for manufacturing a high frequency inductor, and more particularly, to a method for manufacturing a high frequency inductor capable of preventing a damage of an electrode and deterioration of a product performance by forming a barrier layer on an electrode and then filling an epoxy therein to perform a polishing process.

2. Description of the Related Art

Recently, in accordance with the advancement of miniaturization and complex function of mobile devices, a demand for microminiaturization has also increased for electronic components. Particularly, the miniaturization and high precision of various components used in a high frequency component and a radio frequency block have been required.

High precision and high Q characteristics of an inductance are required to cope with the miniaturization and high frequency of the mobile devices, RF modules, or the like However, a multi-layered inductor according to the related art is constructed by forming a laminate through a printing process and a laminating process for an inter-layer via connection between a coil pattern and a coil on a ceramic insulating layer and then compressing and firing the laminate. As a result, deformation of the coil is easily caused by an electrode blurring in a printing process and by an alignment distortion or an electrode press, or the like, at the time of laminating and compressing, and the deformation of the coil shape is increased due to contraction deformation at the time of firing. Therefore, it is difficult to control a desired inductance value of the inductor and to implement a low direct current resistance. As a result, it is difficult to secure high-Q characteristics required in the high frequency inductor.

RELATED ART DOCUMENT

Patent Document (Patent Document 1) Korean Patent Laid-Open Publication No. 10-2002-0005749

(Patent Document 2) Japanese Patent Laid-Open Publication No. 2009-295759

SUMMARY OF THE INVENTION

An object of the present invention is to provide a method for manufacturing a high frequency inductor capable of preventing a damage of electrode by forming a barrier layer on the electrode and then filling an epoxy therein to perform a polishing process, and capable of preventing a coupler (a dye) from affecting characteristics of elements by not using the coupler (the dye).

According to an exemplary embodiment of the present invention, there is provided a method for manufacturing a high frequency inductor, including; forming a primary coil for manufacturing the high frequency inductor on a wafer; coating a primary PSV on the wafer on which the primary coil is formed; forming a secondary coil for manufacturing the high frequency inductor, after the coating of the primary PSV; coating a secondary PSV, after the forming of the secondary coil; forming a barrier layer on an electrode portion to be exposed of the high frequency inductor, after the coating of the secondary PSV; filling and curing an insulating resin on the wafer, after the forming of the barrier layer; and polishing the cured resin up to the barrier layer to expose the electrode.

The forming of the primary coil may include coating a photoresist on the wafer; exposing the wafer on which the photoresist is coated; developing the wafer, after the exposing of the wafer; plating copper (Cu) on the wafer, after the developing of the wafer; stripping the photoresist, after the plating of the copper; and etching a copper seed layer that is previously formed on the wafer.

In the exposing of the wafer, the exposure may be performed by irradiating a light having light amount of 850 mJ on the wafer.

In the plating of the copper, the copper may be plated with a thickness of 12 μm.

The forming of the secondary coil may include forming a copper seed layer on the wafer on which the coating of the primary PSV is completed; cleaning the wafer, after the forming of the copper seed layer; coating a photoresist on the wafer, after the cleaning of the wafer; exposing the wafer on which the photoresist is coated; developing the wafer, after the exposing of the wafer; plating copper (Cu) on the wafer, after the developing of the wafer; stripping the photoresist, after the plating of the copper; and etching the copper seed layer.

In the exposing of the wafer, the exposure may be performed by irradiating a light having light amount of 850 mJ on the wafer.

In the plating of the copper, the copper may be plated with a thickness of 5 μm.

The barrier layer in the forming of the barrier layer may be formed of a thermosetting polymer or an ultraviolet curable polymer.

The insulating resin in the filling of the insulating resin may be an epoxy resin.

DESCRIPTION OF THE PREFERRED EMBODIMENTS

Figure 1:
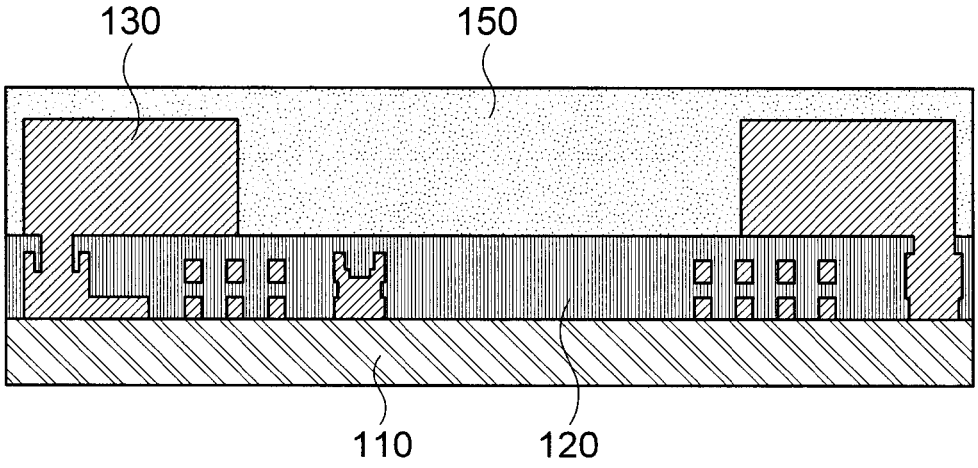
FIG. 1 is a diagram showing a state in which an epoxy is added with a coupler to be filled, after the last electrode is formed according to a method for manufacturing a high frequency inductor according to the related art.

Hereinafter, embodiments of the present invention will be described in detail with reference to the accompanying drawings so that those skilled in the art may easily practice the present invention. However, the present invention may be modified in various different ways and is not limited to the embodiments provided in the present description. In the accompanying drawings, portions unrelated to the description will be omitted in order to obviously describe the present invention, and similar reference numerals will be used to describe similar portions throughout the present specification.

Throughout the present specification, unless explicitly described to the contrary, "comprising" any components will be understood to imply the inclusion of other elements rather than the exclusion of any other elements. A term "part", "module", "unit", or the like, described in the specification means a unit of processing at least one function or operation and may be implemented by hardware or software or a combination of hardware and software.

Hereinafter, exemplary embodiments of the present invention will be described in detail with reference to the accompanying drawings.

Here, a method for manufacturing a high frequency inductor according to the related art will be briefly described, before describing the exemplary embodiments of the present invention.

An inductor that is an electronic component needs anisotropic magnetic material combination and assembly and an airgap at the time of assembling the anisotropic magnetic material significantly affects an electrical characteristics. The airgap is electrically neutral, but the inductor that is a core type component using inductive magnetic field affects the electrical characteristics according to an existence or non-existence and creation degree of the airgap. In manufacturing the high frequency inductor according to the related art, as shown in FIG. 1, after forming the last electrode 130, the epoxy is used as a filler 150. In this case, it is difficult to confirm exposure and polishing degrees of the electrode in a process of exposing the electrode due to transparent characteristics of the epoxy. Therefore, in order to solve this problem, a coupler (a dye) is added to the epoxy to secure a reliability of the process. However, due to the use of the coupler (dye), air bubbles may be generated in the epoxy, or physical properties of the filler 150 may be changed as compared to a pure epoxy, such that the characteristics of products (inductor) may be deteriorated. In addition, in polishing the epoxy to which the coupler is added, it is still difficult to accurately confirm the polishing degree until the electrode is exposed, such that the electrode may be damaged. In FIG. 1, reference numeral 110 represents a wafer, and reference numeral 120 represents a coil, respectively.

The present invention is proposed to solve the problems in the method for manufacturing the high frequency inductor according to the related art as described above. The present invention proposes a method for manufacturing a high frequency inductor capable of preventing a damage of electrode by forming a barrier layer on the electrode and then filling an epoxy therein to perform a polishing process, and capable of preventing a coupler (dye) from affecting characteristics of elements by not using the coupler (dye).

Figure 2:
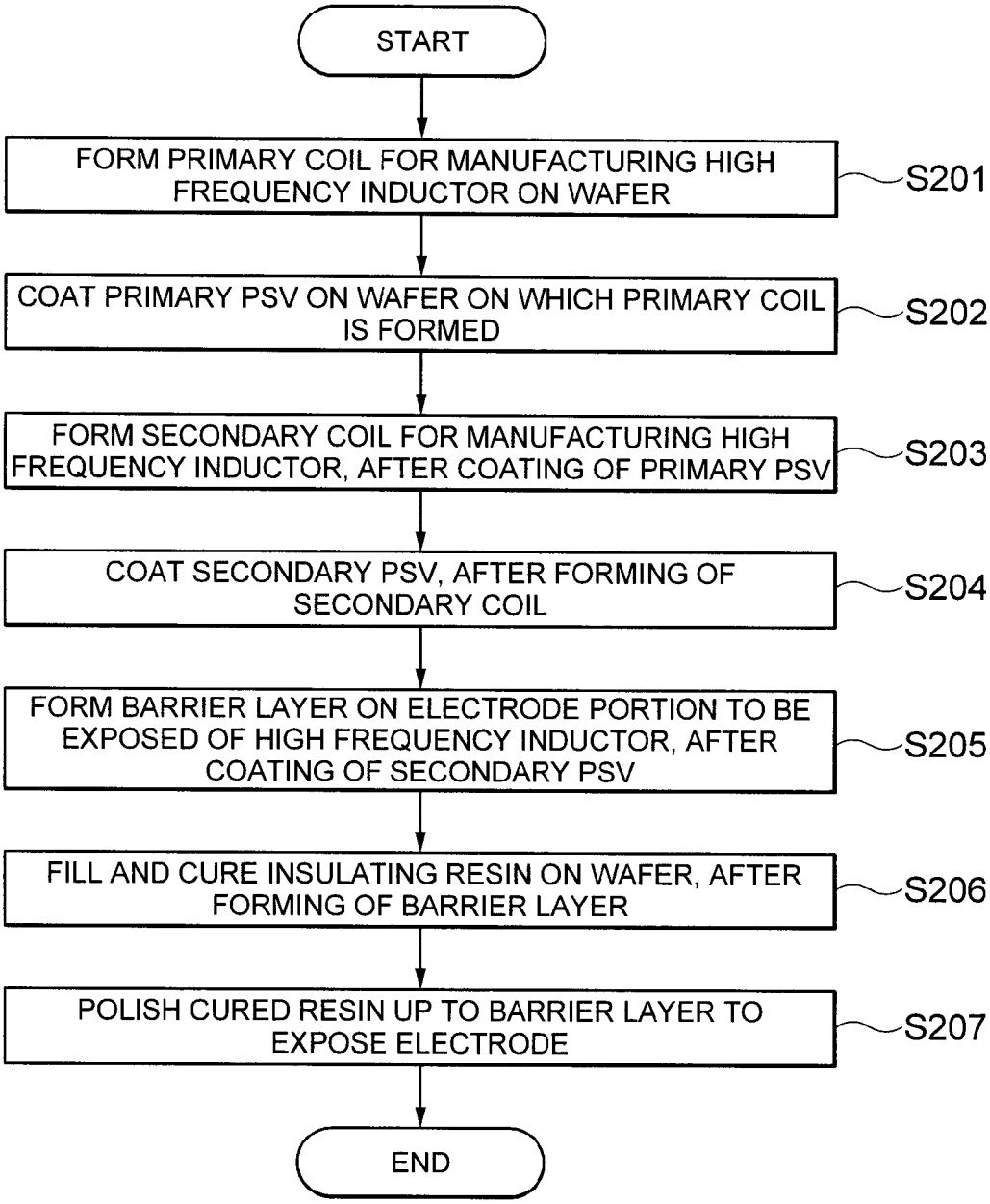
FIG. 2 is a flow chart showing an execution process of the method for manufacturing the high frequency inductor according to an exemplary embodiment of the present invention.

FIG. 2 is a flow chart showing an execution process of the method for manufacturing the high frequency inductor according to an exemplary embodiment of the present invention.

Referring to FIG. 2, according to the method for manufacturing the high frequency inductor according to the exemplary embodiment of the present invention, a primary coil for manufacturing the high frequency inductor is first formed on the wafer (S201).

When the formation of the primary coil is completed, a primary PSV is coated on the wafer on which the primary coil is formed (S202).

In addition, after the primary PSV is coated, a secondary coil for manufacturing the high frequency inductor is formed (S203).

After the secondary coil is formed as described above, a secondary PSV is coated similar to the formation of the primary coil (S204).

After the secondary PSV is coated, a barrier layer is formed on a portion of the electrode to be exposed of the high frequency inductor (S205). Here, a thermosetting polymer or an ultraviolet curable polymer may be used as a material of the barrier layer.

After the barrier layer is formed as described above, an insulating resin is filled on the wafer and is then cured (S206). Here, an epoxy resin may be used as the insulating resin.

When the curing process is completed, the cured resin is polished up to the barrier layer to thereby expose the electrode (S207). Here, a worker may perform the polishing process, while confirming the barrier layer from the beginning through the insulating resin, that is, the transparent epoxy resin, thereby easily confirming whether or not the electrode is exposed by the existence or non-existence of the barrier layer. As a result, the damage of the electrode due to the polishing may be prevented.

Meanwhile, the forming of the primary coil (S201) may be configured to include coating a photoresist on the wafer; exposing the wafer on which the photoresist is coated; developing the wafer after the exposing; plating copper (Cu) on the wafer, after the developing; stripping the photoresist, after the plating of the copper (Cu); and etching a copper seed layer which is previously formed on the wafer.

Here, in the exposing of the wafer, the exposure may be performed by irradiating a light having light amount of 850 mJ on the wafer. Here, the light amount of 850 mJ as mentioned above corresponds to one design value for manufacturing a high frequency inductor having any specific specification, and is not necessarily limited to the light amount value.

In addition, in the plating of the copper (Cu) on the wafer, the copper (Cu) is plated with a thickness of 12 μm. Here, the thickness of 12 μm for plating the copper (Cu) described above also corresponds to one design value for manufacturing a high frequency inductor having any specific specification, and is not necessarily limited to the thickness value.

In addition, the forming of the secondary coil (S203) may be configured to include forming a copper seed layer on the wafer on which the coating of the primary PSV is completed; cleaning the wafer, after the forming of the seed layer; coating a photoresist on the wafer, after the cleaning; exposing the wafer on which the photoresist is coated; developing the wafer, after the exposing; plating a copper (Cu) on the wafer, after the developing; stripping the photoresist, after the plating of the copper; and etching the copper seed layer.

In this configuration, similarly, in the exposing of the wafer, the exposure may be performed by irradiating a light having light amount of 850 mJ on the wafer. Similarly, the light amount of 850 mJ as described above corresponds to one design value for manufacturing a high frequency inductor having any specific specification, and is not necessarily limited to the light amount value.

In addition, in the plating of the copper, the copper (Cu) is plated with a thickness of 5 μm. Here, the thickness of 5 μm for plating the copper as described above similarly corresponds to one design value for manufacturing a high frequency inductor having any specific specification, and is not necessarily limited to the thickness value.

FIGS. 3A to 3F are diagrams schematically describing main processes of the method for manufacturing the high frequency inductor according to the exemplary embodiment of the present invention as described above.

Figure 3A:
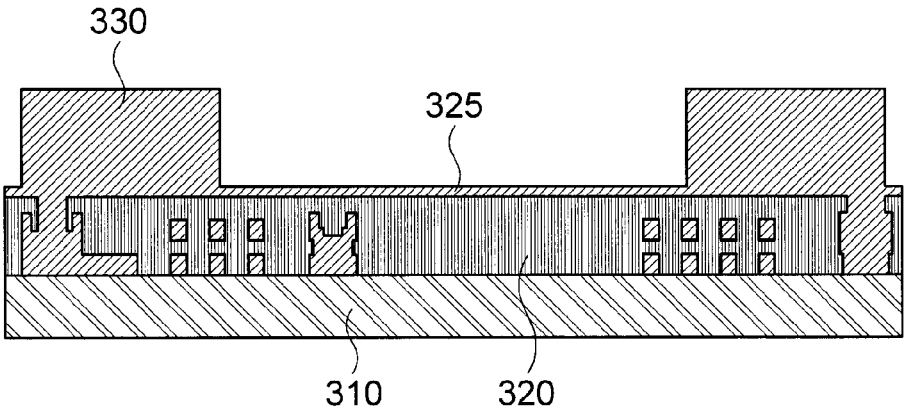
FIGS. 3A to 3F are diagrams schematically describing main processes of the method for manufacturing the high frequency inductor according to the exemplary embodiment of the present invention.
Figure 3B:
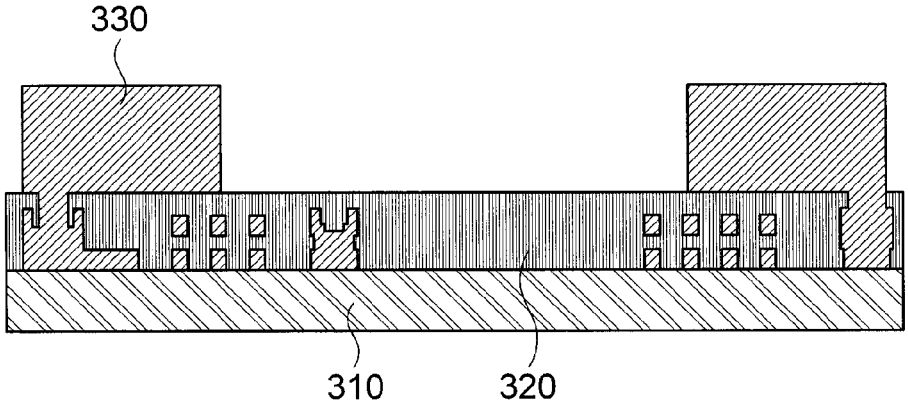

Referring to FIG. 3A, copper is plated on the wafer 310 in the forming of the primary coil (S201) in the method for manufacturing the high frequency inductor according to the exemplary embodiment of the present invention, and the photoresist 325 is then stripped. In addition, referring to FIG. 3B, after the stripping of the photoresist 325, the cooper seed layer 320 that is previously formed on the wafer is etched.

Figure 3C:
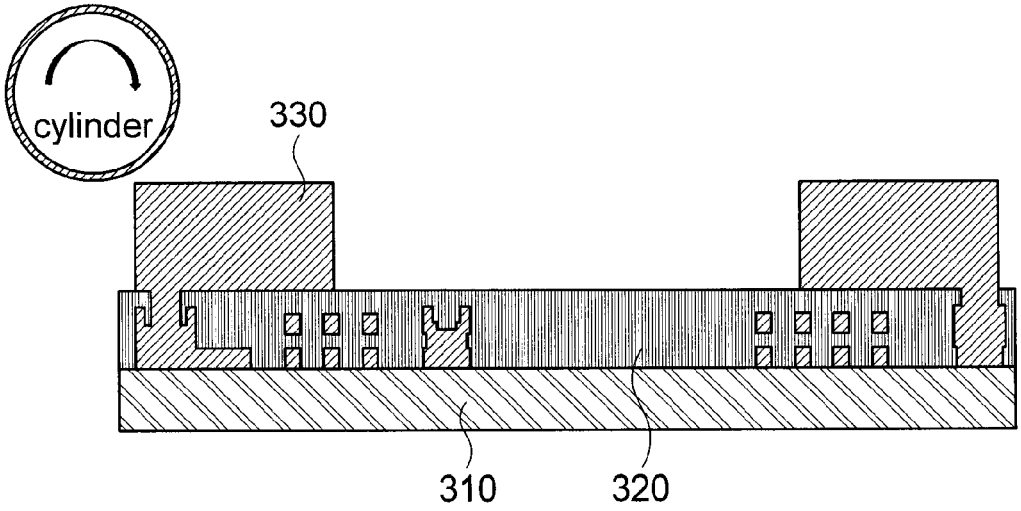
Figure 3D:
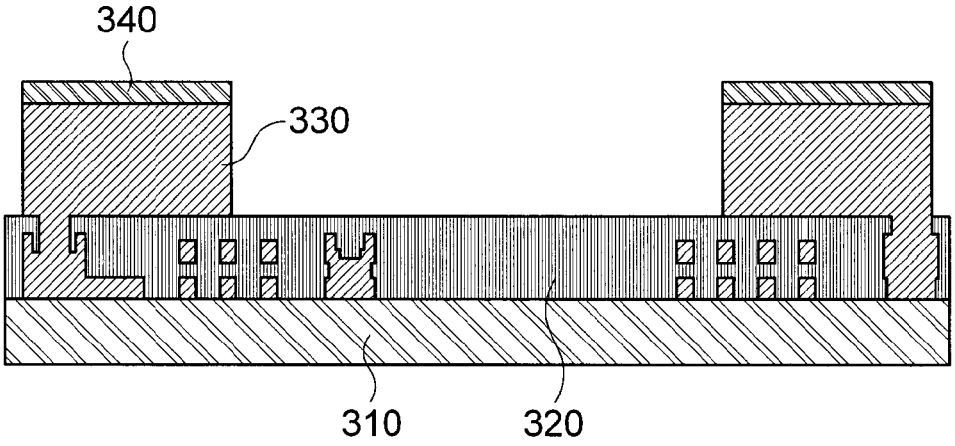

In addition, referring to FIGS. 3C and 3D, after the plating of the secondary PSV, the barrier layer 340 is formed on the portion of the electrode 330 to be exposed of the high frequency inductor using an off-set printing (S205).

Figure 3E:
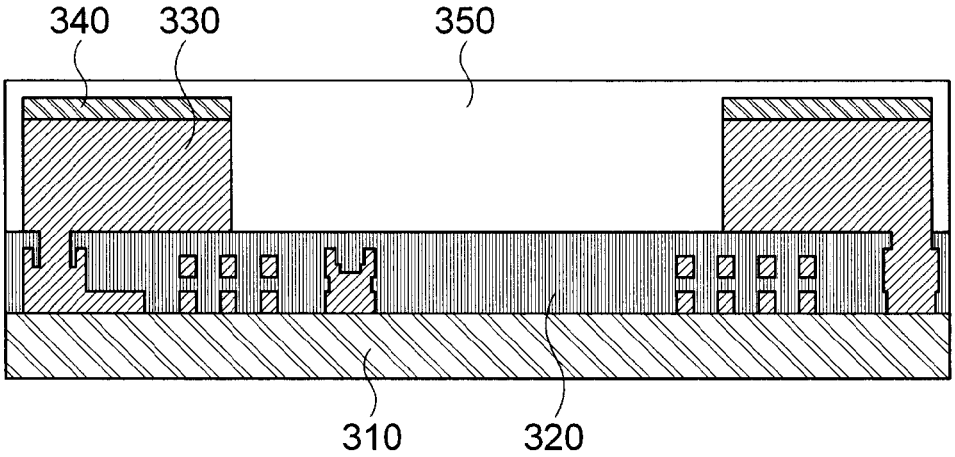
Figure 3F:
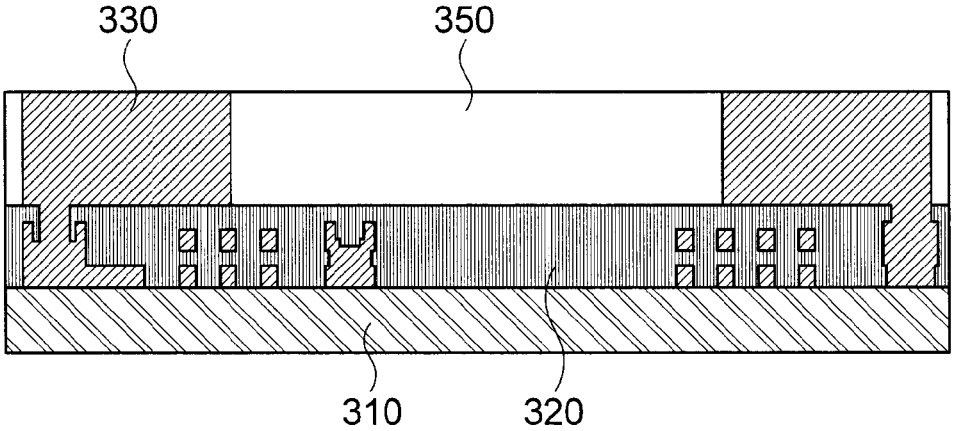

In addition, referring to FIG. 3E, the insulating resin (epoxy resin) 350 is filled and cured on the wafer 310 (S206). Referring to FIG. 3F, the cured resin (epoxy resin) 350 is polished up to the barrier layer 340 to expose the electrode 330 (S207).

As described above, in the method for manufacturing the high frequency inductor according to the exemplary embodiment of the present invention, the barrier layer is formed on the electrode and then is filled with the insulating resin therein, such that it is easy to confirm whether or not the electrode is exposed by the existence or non-existence of the barrier layer when performing an exposure process of the electrode, thereby making it possible to prevent the damage of the electrode due to the polishing.

In addition, the dispersion process of the dye for coloring into the polymer, such as the epoxy used as the filler, is removed, thereby making it possible to prevent the dye according to the related art from adversely affecting the characteristics of the elements.

Although the exemplary embodiments of the present invention have been disclosed, the present invention is not limited thereto, but those skilled in the art will appreciated that various modifications, additions and substitutions are possible, without departing from the scope and sprit of the invention as disclosed in the accompanying claims. Therefore, the true scope of the present invention should be construed by the following claims, and all of the technical spirit of the present invention within equivalent range thereof is included in scope of the present invention.

What is claimed is:

1. A method for manufacturing a high frequency inductor, comprising;

forming a primary coil for manufacturing the high frequency inductor on a wafer;

coating a primary PSV on the wafer on which the primary coil is formed;

forming a secondary coil for manufacturing the high frequency inductor, after the coating of the primary PSV;

coating a secondary PSV, after the forming of the secondary coil;

forming a barrier layer on an electrode portion to be exposed of the high frequency inductor, after the coating of the secondary PSV;

filling and curing an insulating resin on the wafer, after the forming of the barrier layer; and polishing the cured resin up to the barrier layer to expose the electrode.

2. The method according to claim 1, wherein the forming of the primary coil includes:

coating a photoresist on the wafer;

exposing the wafer on which the photoresist is coated;

developing the wafer, after the exposing of the wafer;

plating copper (Cu) on the wafer, after the developing of the wafer;

stripping the photoresist, after the plating of the copper; and etching a copper seed layer that is previously formed on the wafer.

3. The method according to claim 2, wherein in the exposing of the wafer, the exposure is performed by irradiating a light having light amount of 850 mJ on the wafer.

4. The method according to claim 2, wherein in the plating of the copper, the copper is plated with a thickness of 12 μm.

5. The method according to claim 1, wherein the forming of the secondary coil includes:

forming a copper seed layer on the wafer on which the coating of the primary PSV is completed;

cleaning the wafer, after the forming of the copper seed layer;

coating a photoresist on the wafer, after the cleaning of the wafer;

exposing the wafer on which the photoresist is coated;

developing the wafer, after the exposing of the wafer;

plating copper (Cu) on the wafer, after the developing of the wafer;

stripping the photoresist, after the plating of the copper; and etching the copper seed layer.

6. The method according to claim 5, wherein in the exposing of the wafer, the exposure is performed by irradiating a light having light amount of 850 mJ on the wafer.

7. The method according to claim 5, wherein in the plating of the copper, the copper is plated with a thickness of 5 μm.

8. The method according to claim 1, wherein the barrier layer in the forming of the barrier layer is formed of a thermosetting polymer or an ultraviolet curable polymer.

9. The method according to claim 1, wherein the insulating resin in the filling of the insulating resin is an epoxy resin.

* * * * *